US007669509B2

(12) United States Patent
Yamaguchi et al.

(10) Patent No.: US 7,669,509 B2
(45) Date of Patent: Mar. 2, 2010

(54) GUILLOTINE CUTTER

(75) Inventors: Chuji Yamaguchi, Shiga (JP); Hitoshi Uchida, Shiga (JP); Akira Nakajima, Shiga (JP); Tetsuya Kawagoe, Shiga (JP); Takakazu Hori, Shiga (JP); Jun Mochizuki, Shiga (JP); Eiji Katayama, Shiga (JP)

(73) Assignee: Horizon International Inc., Shiea (JP)

( * ) Notice: Subject to any disclaimer, the term of this patent is extended or adjusted under 35 U.S.C. 154(b) by 146 days.

(21) Appl. No.: 11/800,819

(22) Filed: May 8, 2007

(65) Prior Publication Data

US 2007/0261525 A1 Nov. 15, 2007

(30) Foreign Application Priority Data

May 10, 2006 (JP) ..... 2006-131240

(51) Int. Cl.
*B26D 1/08* (2006.01)
*B25B 1/06* (2006.01)

(52) U.S. Cl. ..... 83/460; 269/254 CS; 83/651; 83/697

(58) Field of Classification Search ..... 83/651, 83/697, 698.71, 699.11, 157, 620, 460; 269/55, 269/56, 71, 254 CS, 320
See application file for complete search history.

(56) References Cited

U.S. PATENT DOCUMENTS 1,243,390 A * 10/1917 Dobbins ..... 83/734
1,971,647 A * 8/1934 Freeman ..... 83/165
2,346,100 A * 4/1944 Wright ..... 83/378
2,506,436 A * 5/1950 Seybold ..... 269/32
3,182,542 A * 5/1965 Cochran ..... 83/453

(Continued)

FOREIGN PATENT DOCUMENTS

DE 20 2006000782 U1 4/2006
JP 2001088090 4/2001

OTHER PUBLICATIONS

Derwent abstract of De 20 2006 000 782 U1.FESTO AG & CO[FSTM]. Derwent document No. 2006-307789.*

*Primary Examiner*—Kenneth E. Peterson
*Assistant Examiner*—Sean Michalski
(74) *Attorney, Agent, or Firm*—Kirschstein, et al.

(57) ABSTRACT

A guillotine cutter (1) of the invention is provided with a pressing block driving mechanism (6) positioning a pressing block (5) at a standby position which is spaced upwardly from a sheet bundle (10), a first operating position pressing the sheet bundle by a first pressing force, and a second operating position pressing the sheet bundle by a second pressing force which is larger than the first pressing force. The pressing block is carried by a rod (61) through a compression spring (62) at the standby position, the pressing block is supported on an upper surface of the sheet bundle at the first operating position, thereby applying the first pressing force to the sheet bundle on the basis of a resultant force of a gravitational force generated by its own weight and an biasing force generated by the compression spring, and the pressing block is pushed down by an expansion portion (61*b*) of the rod while the pressing block is kept being supported on the upper surface of the sheet bundle at the second operating position, thereby applying the second pressing force on the basis of a resultant force of the first pressing force and the push-down force generated by the rod.

3 Claims, 4 Drawing Sheets

U.S. PATENT DOCUMENTS

| | | | | | |
|---|---|---|---|---|---|
| 3,218,058 | A | * | 11/1965 | Smith | 269/166 |
| 3,484,896 | A | * | 12/1969 | Greenman | 452/195 |
| 3,677,123 | A | * | 7/1972 | Gerber et al. | 83/561 |
| 4,244,255 | A | * | 1/1981 | Dykstra | 83/631 |
| 4,445,409 | A | * | 5/1984 | Mohr et al. | 83/157 |
| 4,505,173 | A | * | 3/1985 | Hartlage | 83/112 |
| 4,850,257 | A | * | 7/1989 | Mohr | 83/93 |
| 5,037,253 | A | * | 8/1991 | Molaro et al. | 409/190 |
| 5,103,702 | A | * | 4/1992 | Yannazzone | 83/29 |
| 5,209,149 | A | * | 5/1993 | Mohr | 83/91 |
| 5,214,992 | A | * | 6/1993 | Mohr | 83/268 |
| 5,390,576 | A | * | 2/1995 | Ishibashi | 83/613 |
| 5,584,183 | A | * | 12/1996 | Wright et al. | 62/3.7 |
| 6,705,217 | B1 | * | 3/2004 | Godsey et al. | 101/35 |
| 6,782,788 | B1 | * | 8/2004 | Kutchmarek et al. | 83/697 |
| 7,428,859 | B2 | * | 9/2008 | Fujita et al. | 83/456 |
| 2001/0042431 | A1 | * | 11/2001 | Epskamp et al. | 83/694 |
| 2005/0211042 | A1 | * | 9/2005 | Kikuchi | 83/613 |
| 2006/0123969 | A1 | * | 6/2006 | Fujita et al. | 83/697 |

* cited by examiner

GUILLOTINE CUTTER

BACKGROUND OF THE INVENTION

1. Field of the Invention

The present invention relates to a guillotine cutter provided with a pressing block for pressing a sheet bundle or the like to be cut to a sheet bundle supporting table.

2. Description of the Related Art

A conventional guillotine cutter 11 is provided with a rectangular sheet bundle supporting table 3 fixed to a frame 2, and a guillotine cutter blade 4 extending along one line of the sheet bundle supporting table 3 and arranged for vertical movement, as shown in FIGS. 4A and 4B. The guillotine cutter 11 is further provided with a pressing block 15 for pressing the sheet bundle 10 supported on the sheet bundle supporting table 3 to the sheet bundle supporting table 3, and a pressing block driving mechanism 16 designed to vertically move the pressing block 15.

The pressing block driving mechanism 16 has rods 161, 161. One ends of the rods 161,161 are coupled to the pressing block 15, and the other ends thereof are coupled to one ends of swing arms 63,63. The swing arms 63,63 are can be swung around a horizontal axis 63*a* fixed to the frame 2. The pressing block driving mechanism 16 further comprises a vertically movable moving plate 64 which supports the other ends of the swing arms 63,63 in such a manner that the swing arms 63,63 can freely swing, and a feed screw 65 extending in a vertical direction and screwed with the moving plate 64. Further, the pressing block driving mechanism 16 is provided with a pulley 66 fixed to a lower end of the feed screw 65, first and second servo motors 168*a* and 168*b* driving the pulley 66 through a belt 67, and a controller 169 controlling the servo motors 168*a* and 168*b*.

The first servo motor 168*a* is a low-power servo motor for loading a small pressing force, for example, about 50 kg weight to the sheet bundle 10. On the other hand, the second servo motor 168*b* a high-power servo motor for loading a large pressing force, for example, about 2 ton weight to the sheet bundle 10. The servo motors 168*a* and 168*b* can be driven alternately.

In accordance with this guillotine cutter 11, the sheet bundle 10 is pressed to the sheet bundle supporting table 3 by the small pressing force by using the low-power servo motor 168*a* while temporarily holding by a hand of worker, thereby temporarily fixing. The sheet bundle 10 is pressed against the sheet bundle supporting table 3 by the large pressing force by using the high-power servo motor 168*b* after pulling back the hand of worker to a safe region. In other words, in accordance with the guillotine cutter 11, there is no risk that the hand of the worker is crushed by the large pressing force, and it is possible to work safely.

However, it is necessary to provide two various servo motors that is the high-power servo motor and the low-power servo motor, so that high cost was required. Further, the control mechanism of both the servo motors was complicated. In this case, it is desired that the large pressing force of about 2 ton weight and the small pressing force of about 50 kg weight are generated by using a single servo motor, however, since a power gap between both the pressing forces is very large, it was almost impossible to achieve this.

SUMMARY OF THE INVENTION

Accordingly, an object of the present invention is to provide a guillotine cutter comprising single servo motor and selectively applying the small and large pressing forces to the sheet bundle. In order to achieve the object, in accordance with the present invention, there is provided a guillotine cutter comprising;

a sheet bundle supporting table fixed to a frame;

a guillotine cutter blade extending along one linear side edge of the sheet bundle supporting table and arranged for vertical movement;

a pressing block for pressing a sheet bundle supported on the sheet bundle supporting table against the sheet bundle supporting table; and a pressing block driving mechanism supporting the pressing block for vertical movement and positioning the pressing block at a standby position at which the pressing block is spaced upwardly from the sheet bundle, at a first operating position at which the pressing block presses the sheet bundle by a first pressing force, and at a second operating position at which the pressing block presses the sheet bundle by a second pressing force, the second pressing force being larger than the first pressing force, the guillotine cutter characterized in that the pressing block driving mechanism comprises:

at least one rod arranged for vertical movement along its axial direction, the pressing block being coupled to the rod for movement relative to each other, the rod being provided with an expansion portion at a first portion extending upwardly from the pressing block, the expansion portion being capable of engaging with an upper end surface of the pressing block, and that the pressing block driving mechanism further comprises:

a compression spring for upwardly biasing the pressing block fixed to a second portion of the rod at its lower end, the second portion extending downwardly from the pressing block, the compression spring abutting on the pressing block at its upper end;

a driving means connected to the rod so as to vertically move the rod and the pressing block; and a controller controlling the driving means in such a manner that the pressing block is sequentially moved down from the standby position to the second operating position through the first operating position, whereby the pressing block is supported by the rod through the compression spring at the standby position, the pressing block is supported on an upper surface of the sheet bundle at the first operating position in such a manner that the pressing block applies the first pressing force to the sheet bundle composed of a resultant force of a gravitational force generated by its own weight and an biasing force generated by the compression spring, and the pressing block is pushed down by the expansion portion of the rod while the pressing block is kept being supported on the upper surface of the sheet bundle at the second operating position in such a manner that the pressing block applies the second pressing force to the sheet bundle composed of a resultant force of the first pressing force and the push-down force generated by the rod.

In accordance with a preferable embodiment of the present invention, the pressing block driving mechanism further comprises a detector detecting a position of the pressing block relative to the rod at any time, and the controller calculates a compression and an biasing force of the compression spring, and the first pressing force at any time on the basis of the position detected by the detector, and determines that the pressing block reaches the first operating position when the calculated first pressing force is equal to a predetermined value.

In accordance with the other preferable embodiment of the present invention, the driving means comprises:

a coupling arm connected to a lower end of the rod at its one end through a pin for swing movement around the pin;

a swing arm connected to the other end of the coupling arm at its one end through a pin for swing movement around the pin, and carried by a horizontal axis for swing movement, the horizontal axis being fixed to the frame;

a moving plate arranged for vertical movement along a guide fixed to the frame, and coupled to the other end of the swing arm;

a feed screw extending in a vertical direction and screwed with the moving plate;

a pulley fixed to a lower end of the feed screw;

a servo motor provided with a rotary drive shaft extending in a vertical direction and the other pulley fixed to a leading end of the rotary drive shad; and a endless belt extended between the pulley and the other pulley of the servo motor.

Further, in accordance with the present invention, there is provided a guillotine cutter comprising:

a sheet bundle supporting table fixed to a frame;

a guillotine cutter blade extending along one linear side edge of the sheet bundle supporting table and arranged for vertical movement;

a pressing block for pressing a sheet bundle supported on the sheet bundle supporting table against the sheet bundle supporting table; and a pressing block driving mechanism supporting the pressing block for vertical movement and positioning the pressing block at a standby position at which the pressing block is spaced upwardly from the sheet bundle, at a first operating position at which the pressing block presses the sheet bundle by a first pressing force, and at a second operating position at which the pressing block presses the sheet bundle by a second pressing force, the second pressing force being larger than the first pressing force, the guillotine cutter characterized in that the pressing block driving mechanism comprises:

at least one rod arranged for vertical movement along its axial direction, the pressing block being coupled to the rod for movement relative to each other, the rod being provided with an upper expansion portion at a first portion extending upwardly from the pressing block, the upper expansion portion being capable of engaging with an upper end surface of the pressing block, and a lower expansion portion at a second portion extending downwardly from the pressing block, the lower expansion portion being capable of engaging with a lower end surface of the pressing block, and that the pressing block driving mechanism further comprises:

a driving means connected to the rod so as to vertically move the rod and the pressing block; and a controller controlling the driving means in such a manner that the pressing block is sequentially move down from the standby position to the second operating position through the first operating position, whereby the pressing block is supported by the lower expansion portion of the rod at the standby position, the pressing block is supported on an upper surface of the sheet bundle and is not supported by the lower expansion portion at the first operating position in such a manner that the pressing block applies the first pressing force to the sheet bundle composed of a gravitational force generated by its own weight, and the pressing block is pushed down by the upper expansion portion of the rod while the pressing block is kept being supported on the upper surface of the sheet bundle at the second operating position in such a manner that the pressing block applies the second pressing force to the sheet bundle composed of a resultant force of the first pressing force and the push-down force generated by the rod.

In accordance with the guillotine cutter of the present invention, it is possible to selectively apply the small and large pressing forces to the sheet bundle by the pressing block, in spite of the simple and inexpensive structure.

DETAILED DESCRIPTION OF PREFERABLE EMBODIMENTS

A preferred embodiment of the present invention will be explained in detail with reference to the accompanying drawings.

Figure 1:
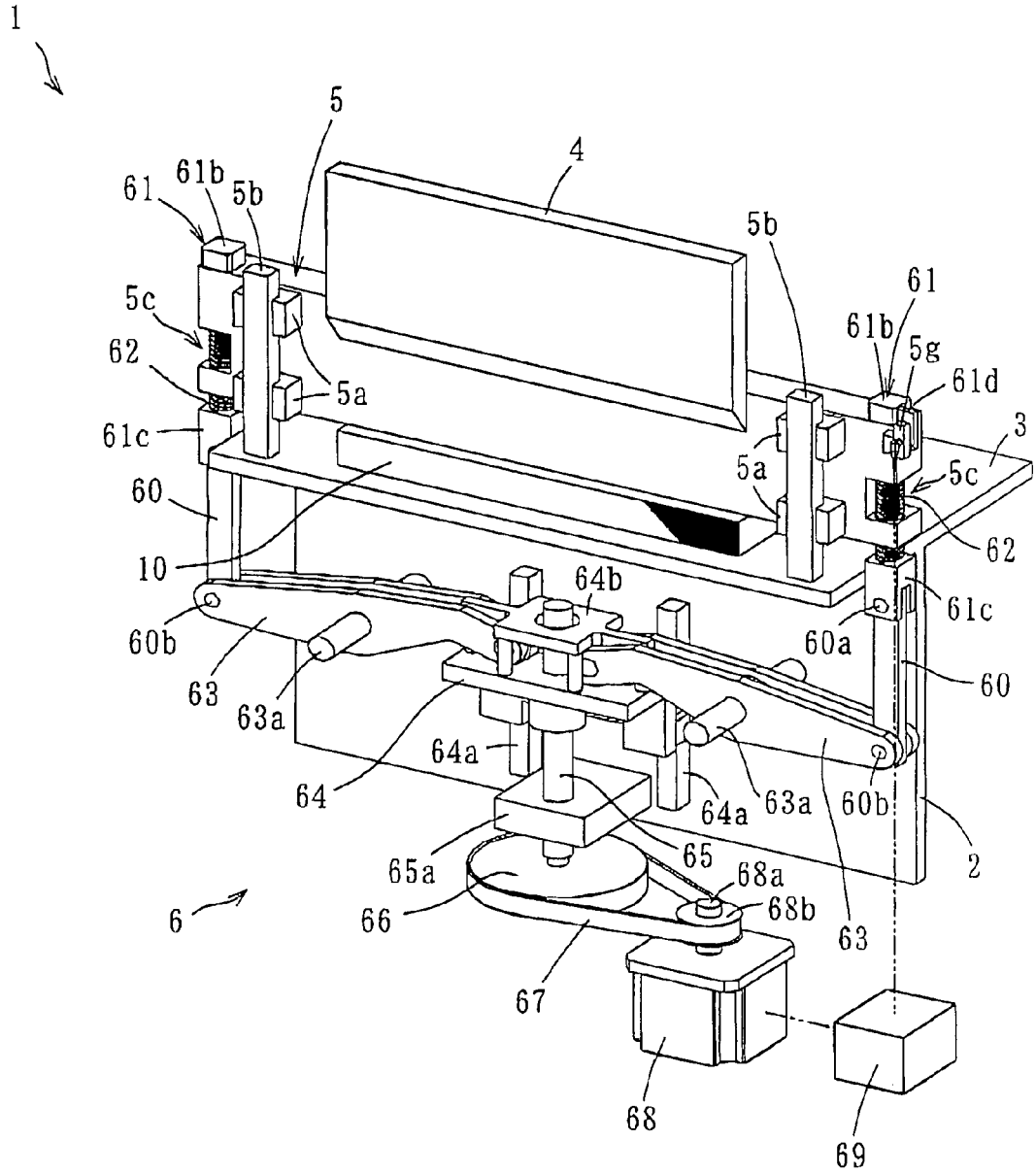
FIG. 1 is a perspective view illustrating a guillotine cutter in accordance with the present invention.
Figure 2:
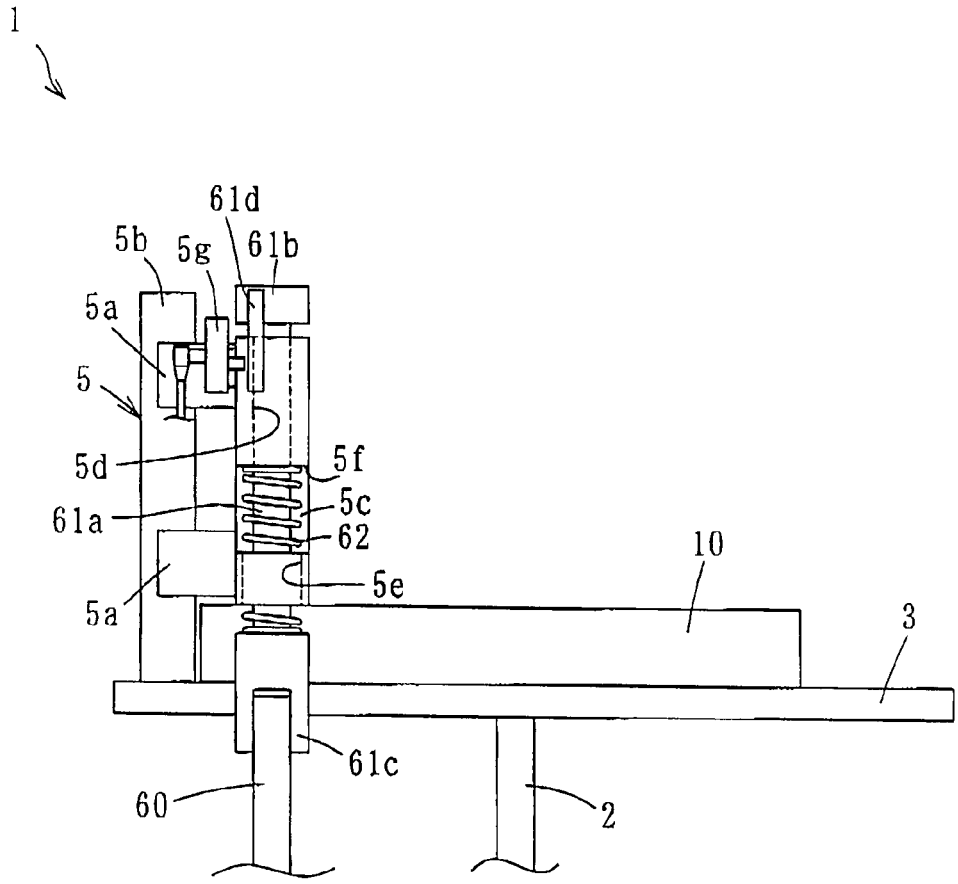
FIG. 2 is a side elevational view illustrating a structure of a main portion of the guillotine cutter in accordance with the present invention.

As shown in FIGS. 1 and 2, in accordance with the present invention, there are provided with a rectangular sheet bundle supporting table 3 fixed to a frame 2, and a guillotine cutter blade 4 extending along one line of the sheet bundle supporting table 3 and arranged for vertical movement. Further, there are provided with a pressing block 5 pressing a sheet bundle 10 supported on the sheet bundle supporting table 3 to the sheet bundle supporting table 3, and a pressing block driving mechanism 6 vertically moving the pressing block 5.

The pressing block 5 is arranged near the guillotine cutter blade 4. Near the guillotine cutter blade 4 on the sheet bundle supporting table 3, there are provided with guide members 5*b*,5*b* extending upwardly from an upper surface thereof A pair of sliders 5*a*,5*a* are attached to each of the guide members 5*b*, and are guided along the guide 5*b* for slide movement. The pressing block 5 is attached to the slider 5*a* for vertically movement. The pressing block 5 is provided with cutting portions 5*c*,5*c* at its both ends. The pressing block 5 is provided with an upper hole 5*d* extending downwardly from an upper end surface and communicating with the cutting portion 5*c*, and a lower hole 5*e* extending upwardly from a lower end surface and communicating with the cutting portion 5*c*. The upper hole 5*d* and the lower hole 5*e* are coaxially formed, and can accommodate a column portion 61*a* of a rod 61 mentioned below. The lower hole 5*e* can further accommodate a compression spring 62.

The pressing block driving mechanism 6 has the rods 61,61 which extend vertically and are arranged for vertical movement along an axial direction thereof The rod 61 has the column portion 61*a*. The column portion 61*a* is inserted into the upper hole 5*d* and the lower hole 5*e* of the pressing block 5. A length of the column portion 61*a* is longer (for example, 20 mm longer) than a length in a vertical direction of the pressing block 5. An upper expansion portion 61*b* is provided in an upper end of the column portion 61*a* extending upwardly from the pressing block 5. A lower expansion portion 61*c* is provided in a lower end of the column portion 61*b* extending downwardly from the pressing block 5. The upper expansion portion 61*b* is larger than the upper hole 5*e* of the pressing block 5, and can be engaged with the upper end surface of the pressing block 5. The lower expansion portion 61*c* is larger than the lower hole 5*e* of the pressing block 5, and can be engaged with the lower end surface of the pressing block 5. In other words, the rods 61,61 are coupled to both end portions of the pressing block 5 so as to be relatively movable with each other.

The compression springs 62,62 are inserted into the lower holes 5*e*,5*e* of the pressing block 5. The column portion 61*a* of the rod 61 passes through the compression spring 62. The compression spring 62 is brought into contact with the lower expansion portion 61*c* of the rod 61 at a lower end, and is brought into contact with an upper wall 5*f* in the cutting portion 5*c* of the pressing block 5 at an upper end, thereby the pressing block 5 is biased upwardly.

The coupling arms 60,60 are connected to the lower expansion portions 61*c*,61*c* of the rod 61 at one ends by pins 60*a*,60*a* for swing around the pins 60*a*,60*a*.

Swing arms 63,63 are carried by horizontal shafts 63*a*,63*a* fixed to the frame 2, and can swing around the shafts. One end of the swing arm 63 is connected to the other end of the coupling arm 60 by a pin 60*b*, and can swing around the pin 60*b*. The other end of the swing arm 63 is coupled to a moving plate 64.

The moving plate 64 is guided by a guide 64*a* for vertical movement. The guide is fixed to the frame 2 and extending in a vertical direction. The moving plate 64 presses the other ends of the swing arms 63,63 through a pressing plate 64*b* while carrying the other ends of the swing arms 63,63 by an upper surface. The moving plate 64 is screwed with a feed screw 65 extending in a vertical direction. The moving plate 64 is vertically moved with rotation of the feed screw 65.

The feed screw 65 is rotatably carried by a bearing 65*a* fixed to the frame 2. A pulley 66 is fixed to a lower end of the feed screw 65.

A servo motor 68 is provided with a rotary drive shaft 68*a* extending in the vertical direction, and the other pulley 68*b* fixed to a leading end of the rotary drive shaft 68*a*. A endless belt 67 is extended between the pulley 66 and the other pulley 68*b* of the servo motor 68. The servo motor 68 rotates the feed screw 65 in both directions. The servo motor 68 is controlled by a controller 69.

The controller 69 is connected to a detector 5*g* detecting a position of the pressing block 5 relative to the rod 61. The detector 5*g* is attached to a portion of the pressing block 5 near one rod 61. The rod 61 has a detection piece 61*d* at its position facing to the detector 5*g*, and the detection piece 61*d* can be detected by the detector 5*g*. The controller 69 receives a position detection signal outputed from the detector 5*g* at any time. The controller 69 calculates a change in length and an biasing force of the compression spring 62 based on the received signal, at any time. The controller 69 further calculates a first pressing force composed of a resultant force of a previously inputed gravitational force generated by its own weight of the pressing block 5 and the calculated biasing force, at any time. The controller 69 is connected to a foot pedal (not shown) provided in the frame 2 for temporarily pressing, and a switch (not shown) for activating the guillotine cutter blade 4. The controller 69 controls the servo motor 68 on the basis of the signals from the detector 5*g*, the foot pedal and the switch.

A main structural elements of the pressing block driving mechanism 6 are the rods 61,61, the compression springs 62,62, the coupling arms 60,60, the swing arms 63,63, the moving plate 64, the feed screw 65, the pulley 66, the servo motor 68 and the controller 69.

Figure 3:
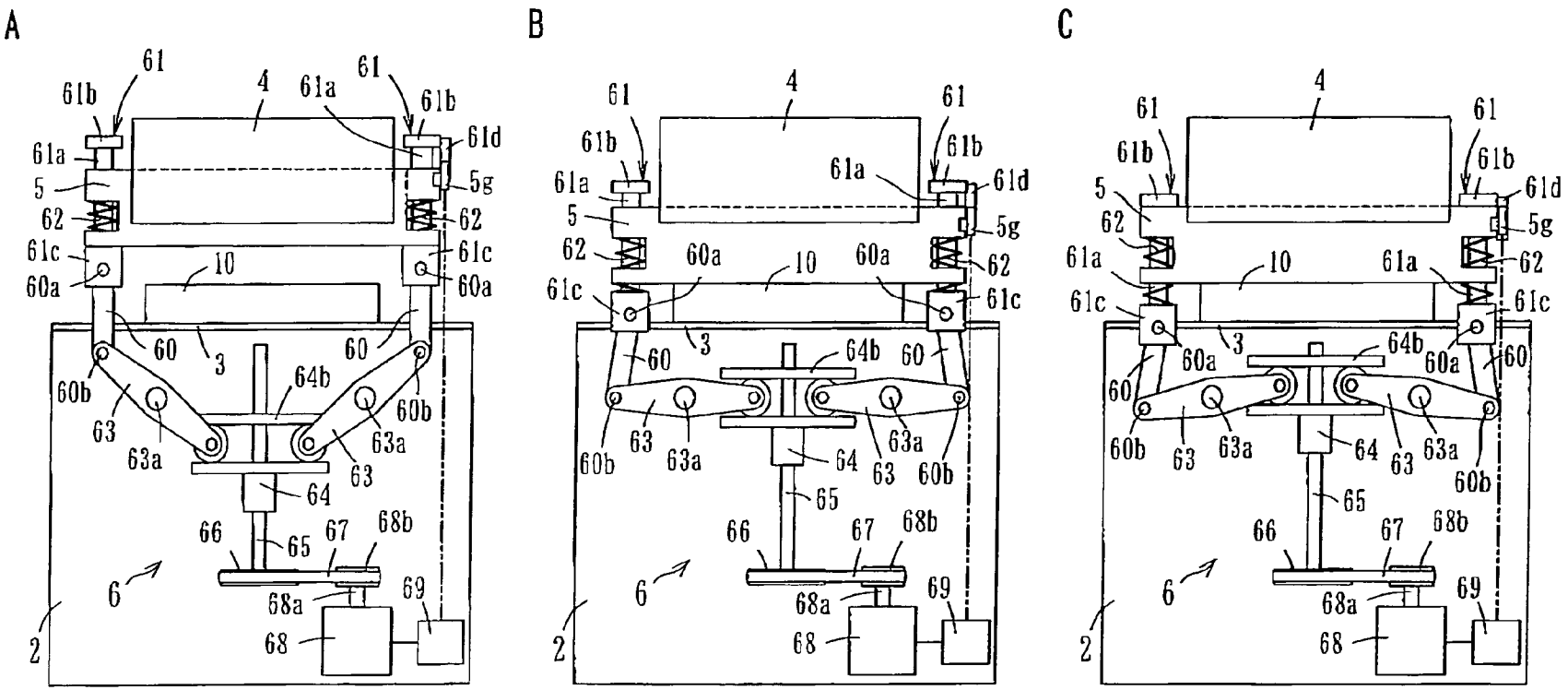
FIG. 3 is a front elevational view illustrating a structure of a main portion of the guillotine cutter in accordance with the present invention.
Figure 4:
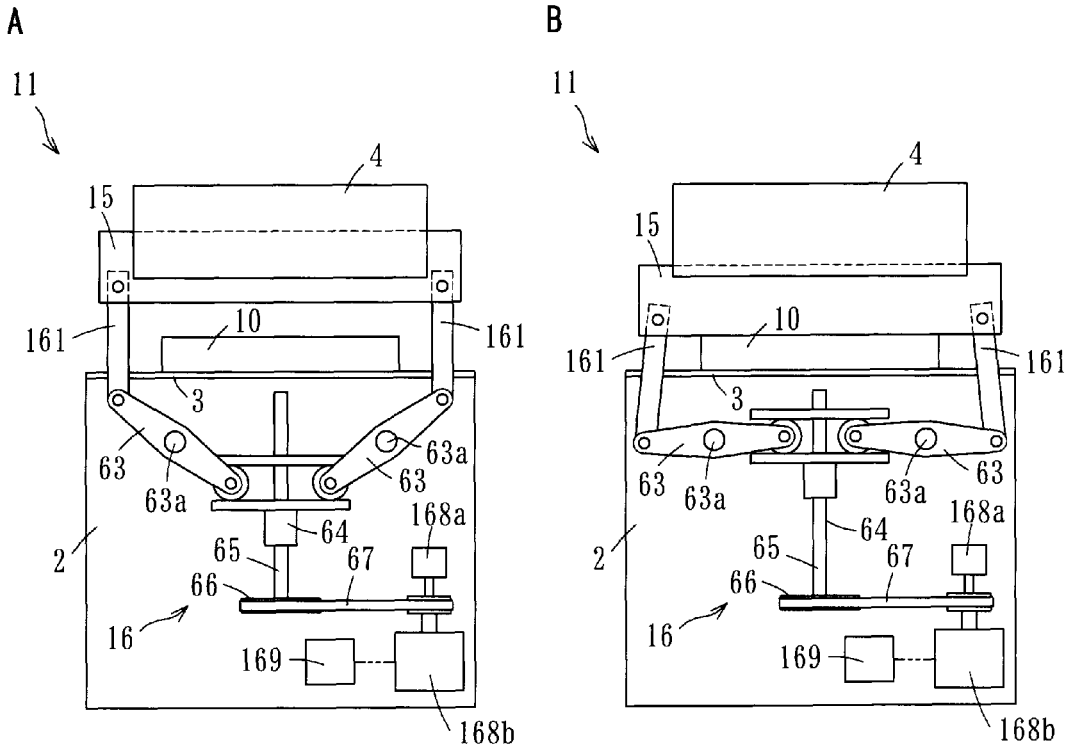
Fig. 4 Prior Art
FIG. 4 is a front elevational view illustrating a structure of a main portion of a conventional guillotine cutter.

Next, an operation of the guillotine cutter 1 in accordance with the present invention will be explained with reference to FIG. 3.

First, the controller 69 rotates the servo motor 68 so as to move down the moving plate 64. The swing arm 63 swings around the horizontal shaft 63*a* with the downward movement of the moving plate 64. The coupling arm 60 and the rod 61 move upwardly with the swing of the swing arm 63. The pressing block 5 moves upwardly with the upward movement of the rod 61, thereby being arranged at a position (a standby position) at which the pressing block (5) is spaced upwardly from the sheet bundle supporting table 3 (refer to FIG. 3A). At this time, the pressing block 5 is carried by the rod 61 through the compression spring 62. In this state, a worker sets the sheet bundle 10 at a predetermined position on the sheet bundle supporting table 3 in an aligned state.

Next, the worker steps on a foot pedal (not shown) while lightly pressing the sheet bundle 10 by a hand. At this time, the controller 69 receives a signal from the foot pedal, and drives the servo motor 68. The moving plate 64 is moved upwardly with the rotation of the feed screw 65 generated by driving the servo motor 68. The rod 61 is moved downwardly through the swing arm 63 and the coupling arm 60 with the upward movement of the moving plate 64. The pressing block 5 supported by the rod 61 is moved downwardly together with the rod 61. If the pressing block 5 is placed on the upper surface of the sheet bundle 10 on the sheet bundle supporting table 3, the rod 61 starts a relative movement with respect to the pressing block 5. If the relative movement is started, the position of the pressing block 5 relative to the rod 61 is changed. A value of the signal outputed from the detector 5*g* is changed by the change of the position. The controller 69 calculates a first pressing force on the basis of the signal from the detector 5*g* at any time. In the case that the calculated first pressing force is equal to a predetermined value, the controller 69 stops the servo motor 68 (refer to FIG. 3B). For example, in the case that the predetermined value of the first pressing force is 10 kg weight, and the gravitational force generated by its own weight of the pressing block 5 is 50 kg weight, the rod 61 stops at a position at which the compression spring is compressed so that the biasing force is equal to 40 kg weight. The sheet bundle 10 is temporarily pressed by the first pressing force. The worker separates his foot from the foot pedal if the alignment of the sheet bundle 10 is out of order, and restarts the work mentioned above. Otherwise, the worker starts the next work.

Next, the worker pulls his hand on the sheet bundle 10 to a safe region, and pushes a switch for activating the guillotine cutter blade 4. At this time, the controller 69 receives the signal from the switch (not shown), drives the servo motor 68 and moves the rod 61 further downwardly. If the rod 61 is downwardly moved toward the pressing block 5 placed on the upper surface of the sheet bundle 10, the upper expansion portion 61*b* of the rod 61 is engaged with the upper end surface of the pressing block 5. If the rod 61 is further moved downwardly, the pressing block 5 is pushed down by the upper expansion portion 61*b*. The controller 69 stops the servo motor 68 when a torque of the servo motor is equal to a predetermined value (refer to FIG. 3C). At this time, the pressing block 5 presses the sheet bundle 10 by a second pressing force composed of a resultant force of the first pressing force and the push-down force by the rod 61, The second pressing force has a magnitude of, for example, about 2 ton weight, and presses the sheet bundle 10 so as to prevent the sheet bundle 10 from being deviated at a time of sheet cutting.

After the stop of the servo motor 68, the sheet bundle 10 is cut by a vertical reciprocating movement of the guillotine cutter blade 4.

In accordance with the guillotine cutter of the present invention, it is possible to selectively apply the small pressing force (for example, 10 kg weight) and large pressing force (for example, 2 ton weight) to the sheet bundle by the pressing block in the simple and inexpensive structure. Further, the worker can temporarily press safely, accordingly. Further, in accordance with the guillotine cutter of the present inventions it is possible to optionally set the pressing force applied to the sheet bundle at temporarily pressing.

In this case, if the pressing block is structured such that the pressing block is relatively light and its own weight applies the pressing force suitable for temporarily pressing, the compression spring may not be employed. In this case, the first pressing force is composed of only by the gravitational force generated by its own weight of the pressing block.

What is claimed is:

1. A guillotine cutter comprising:

a sheet bundle supporting table fixed to a frame;

a guillotine cutter blade extending along one linear side edge of said sheet bundle supporting table and arranged for vertical movement;

a pressing block for pressing a sheet bundle supported on said sheet bundle supporting table against said sheet bundle supporting table;

a pressing block driving mechanism supporting said pressing block for vertical movement and positioning said pressing block at a standby position at which said pressing block is spaced upwardly from said sheet bundle, at a first operating position at which said pressing block presses said sheet bundle by a first pressing force, and at a second operating position at which said pressing block presses said sheet bundle by a second pressing force, said second pressing force being larger than said first pressing force;

a driving means; and a controller;

characterized in that said pressing block driving mechanism comprises at least one rod arranged for vertical movement along its axial direction;

said rod and said pressing block being coupled to each other in such a manner that said rod can move in its axial direction with respect to said pressing block, said rod being provided with an expansion portion at a first portion extending upwardly from said pressing block, said expansion portion being capable of engaging with an upper end surface of said pressing block, and that said pressing block driving mechanism further comprises a compression spring for upwardly biasing said pressing block fixed to a second portion of said rod at its lower end, said second portion extending downwardly from said pressing block, said compression spring abutting on said pressing block at its upper end, said driving means being connected to said rod so as to vertically move said rod and said pressing block, said controller controlling said driving means in such a manner that said pressing block is sequentially moved down from said standby position to said second operating position through said first operating position, whereby said pressing block is supported by said rod through said compression spring at said standby position, said pressing block is supported on an upper surface of said sheet bundle at said first operating position in such a manner that said pressing block applies said first pressing force to said sheet bundle composed of a resultant force of a gravitational force generated by its own weight and a biasing force generated by said compression spring, and said pressing block is pushed down by the expansion portion of said rod while said pressing block is kept being supported on the upper surface of said sheet bundle at said second operating position in such a manner that said pressing block applies said second pressing force to said sheet bundle composed of a resultant force of said first pressing force and the push-down force generated by said rod.

2. The guillotine cutter according to claim 1, characterized in that said pressing block driving mechanism further comprises a detector detecting a position of said pressing block relative to said rod at any time, and said controller calculates a compression and a biasing force of said compression spring, and said first pressing force at any time on the basis of said position detected by said detector, and determines that said pressing block reaches said first operating position when said calculated first pressing force is equal to a predetermined value.

3. The guillotine cutter according to claim 2, characterized in that said driving means comprises:

a coupling arm connected to a lower end of said rod at its one end through a pin for swing movement around the pin;

a swing arm connected to the other end of said coupling arm at its one end through a pin for swing movement around the pin, and carried by a horizontal axis for swing movement, said horizontal axis being fixed to said frame;

a moving plate arranged for vertical movement along a guide fixed to said frame, and coupled to the other end of said swing arm;

a feed screw extending in a vertical direction and screwed with said moving plate;

a pulley fixed to a lower end of said feed screw;

a servo motor provided with a rotary drive shaft extending in a vertical direction and the other pulley fixed to a leading end of said rotary drive shaft; and an endless belt extended between said pulley and said other pulley of said servo motor.

* * * * *